US010761467B1

(12) United States Patent
Kurosawa

(10) Patent No.: US 10,761,467 B1
(45) Date of Patent: Sep. 1, 2020

(54) IMAGE FORMING APPARATUS AND IMAGE POSITION ADJUSTMENT METHOD

(71) Applicant: TOSHIBA TEC KABUSHIKI KAISHA, Shinagawa-ku, Tokyo (JP)

(72) Inventor: Norio Kurosawa, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/552,040

(22) Filed: Aug. 27, 2019

(51) Int. Cl.
*G03G 15/00* (2006.01)

(52) U.S. Cl.
CPC ..... *G03G 15/5054* (2013.01)

(58) Field of Classification Search
None
See application file for complete search history.

(56) References Cited

U.S. PATENT DOCUMENTS

| | | | | |
|---|---|---|---|---|
| 8,120,630 | B2 | 2/2012 | Kurosawa | |
| 2007/0274745 | A1* | 11/2007 | Ueda | G03G 15/0131 399/301 |
| 2008/0292370 | A1* | 11/2008 | Murayama | G03G 15/0131 399/301 |

* cited by examiner

*Primary Examiner* — Roy Y Yi
(74) *Attorney, Agent, or Firm* — Foley & Lardner LLP

(57) ABSTRACT

According to one embodiment, an image forming apparatus includes an image forming unit, a sensor, and a control unit. The image forming unit forms a pattern constituted by a plurality of straight lines intersecting each other on a sheet or a transfer belt. The sensor detects the pattern formed on the sheet or the transfer belt. The control unit adjusts a writing position in a main scanning direction on the basis of the pattern detected by the sensor.

15 Claims, 9 Drawing Sheets

IMAGE FORMING APPARATUS AND IMAGE POSITION ADJUSTMENT METHOD

FIELD

Embodiments described herein relate generally to image forming apparatus and image position adjustment method.

BACKGROUND

In recent years, hitting position adjustment in a main scanning direction using an image forming apparatuses is performed by transferring toners formed on transfer belts to sheets. For example, as shown in FIG. 14, a wedge-shaped correction pattern 200 may include two straight lines, each formed on a transfer belt 31. The straight lines are detected by a sensor 37, and the position of a vertex of the correction pattern 200 is calculated on the basis of a vertex angle and a detected distance of the correction pattern 200. However, it is not possible to accurately calculate the position of the vertex using such a system due to a fluctuation in sub-scanning magnification. For example, when the vertex of the correction pattern 200 is directly detected by the sensor 37, the influence of a fluctuation in the sub-scanning magnification is not prominent. As a result, it may not be possible to detect the vertex of the correction pattern 200 depending on the position of the correction pattern 200.

DETAILED DESCRIPTION

In general, according to one embodiment, an image forming apparatus includes an image forming unit, a sensor, and a control unit. The image forming unit forms a pattern constituted by a plurality of straight lines intersecting each other on an image carrier. The sensor detects the pattern formed on the image carrier. The control unit adjusts a writing position in a main scanning direction for each color on the basis of the pattern detected by the sensor.

Hereinafter, an image forming apparatus and an image position adjustment method according to an embodiment will be described with reference to the accompanying drawings.

Figure 1:
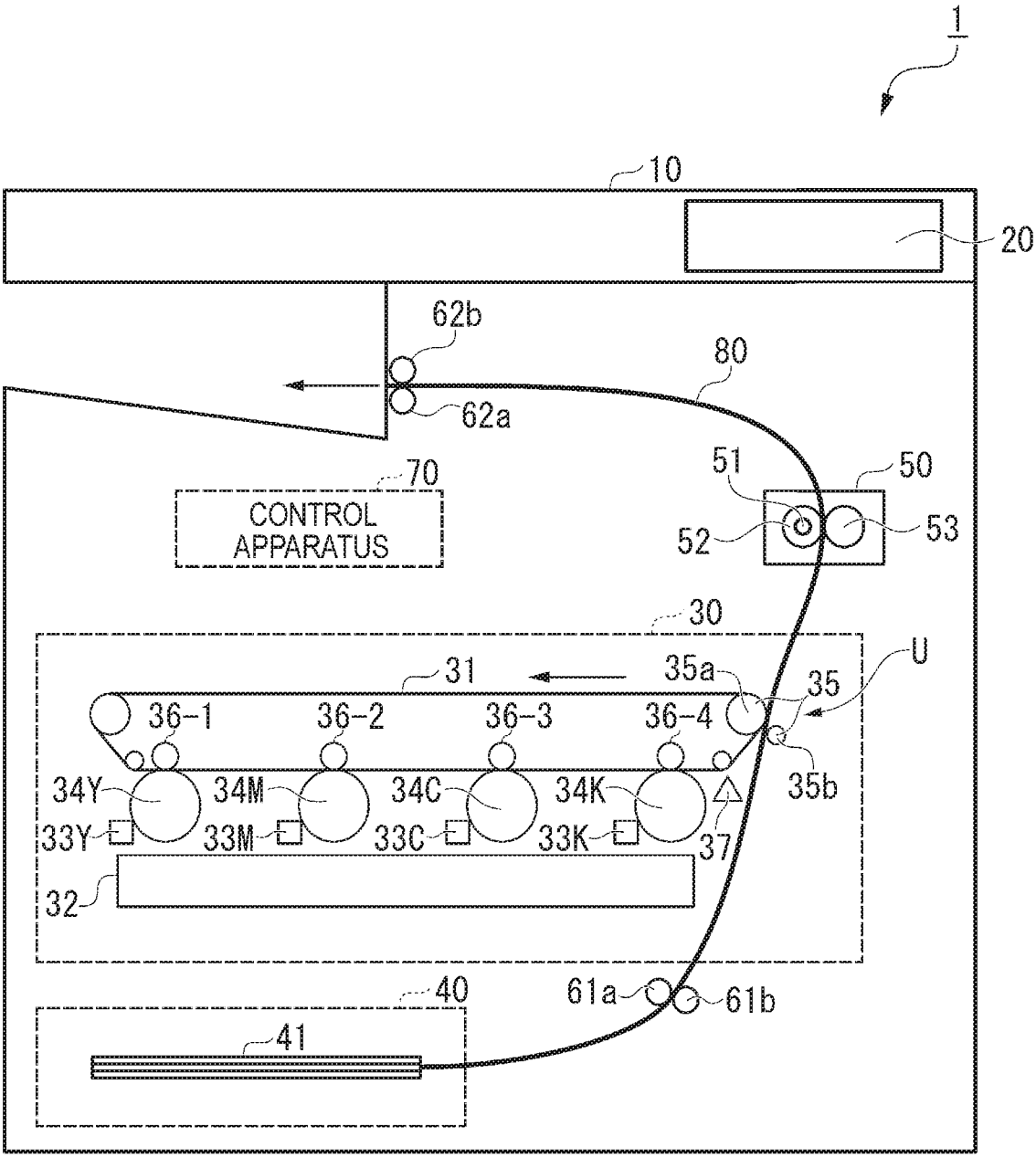
FIG. 1 is an exterior diagram showing an overall configuration example of an image forming apparatus according to an embodiment.

FIG. 1 is an exterior diagram showing an overall configuration example of an image forming apparatus 1 according to the embodiment. The image forming apparatus 1 according to the embodiment is a multi-function peripheral (MFP). The image forming apparatus 1 executes printing through an image forming process and an image fixing process. The image forming process is a process of forming an image on a sheet. The image fixing process is a process of fixing the image formed on the sheet. The sheet is, for example, paper on which characters, an image, or the like is formed. The sheet may be anything as long as the image forming apparatus 1 can form an image on the sheet.

The image forming apparatus 1 includes an image reading unit 10, a control panel 20, an image forming unit 30, a sheet accommodation portion 40, a fixing device 50, transport rollers 61*a* and 61*b*, paper discharge rollers 62*a* and 62*b*, and a control apparatus 70.

The image reading unit 10 reads an image to be read on an original document as brightness and darkness of light. For example, the image reading unit 10 reads an image printed on an original document to be read which is set in a document read platen. The image reading unit 10 records read image information. The recorded read image information may be transmitted to another information processing apparatus through a network. The recorded read image information may be formed on a sheet by the image forming unit 30.

The control panel 20 includes a display unit and an operation unit. The display unit is a display apparatus such as a liquid crystal display or an organic electro luminescence (EL) display. The display unit displays various information regarding the image forming apparatus 1 under the control of the control apparatus 70. The operation unit includes a plurality of buttons and the like. The operation unit receives a user's operation. For example, the operation unit receives an instruction for executing image position adjustment. The operation unit outputs a signal based on an operation performed by the user to the control apparatus 70. Meanwhile, the display unit and the operation unit may be configured as an integrated touch panel.

Figure 2:
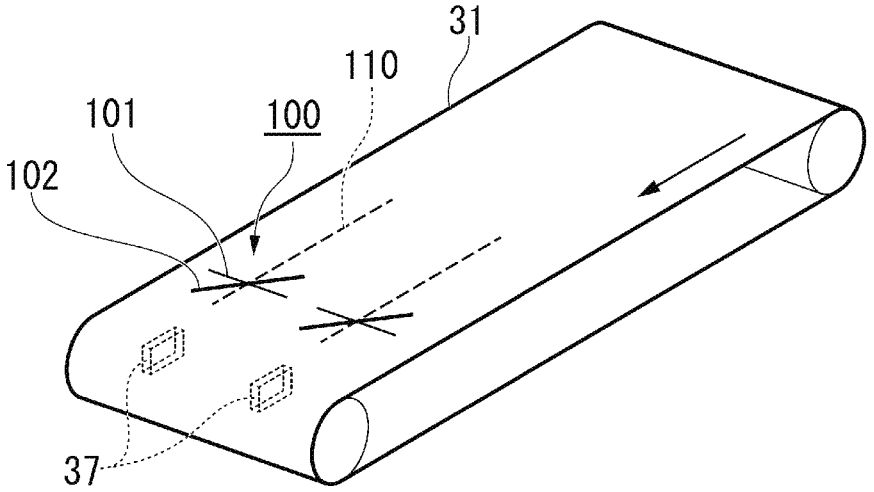
FIG. 2 is a diagram showing an example in which a correction pattern is formed on a transfer belt.

The image forming unit 30 executes an image forming process. Specifically, the image forming unit 30 forms an image based on image information generated by the image reading unit 10 or image information received through a communication path on a sheet. For example, the image forming unit 30 forms a toner image on the sheet using a toner. The image forming unit 30 in the present embodiment forms a correction pattern for adjusting an image position on the transfer belt 31 (image carrier) as shown in FIG. 2. The image forming unit 30 may form the correction pattern on a sheet (image carrier). The correction pattern is constituted by a plurality of straight lines intersecting each other. More specifically, the correction pattern is constituted by a plurality of straight lines having different thicknesses and intersecting each other. For example, the correction pattern may be constituted by a cross including two straight lines having different thicknesses.

FIG. 2 is a diagram showing an example in which a correction pattern 100 in the embodiment is formed on the transfer belt 31.

As shown in FIG. 2, the correction pattern 100 is constituted by a first straight line 101 and a second straight line 102 which intersect each other. The second straight line 102 is thicker than the first straight line 101. Meanwhile, as for the plurality of straight lines, either the first straight line 101 or the second straight line 102 may be thicker as long as the first straight line 101 and the second straight line 102 have different thicknesses. The image forming apparatus 1 sets the thickness of the first straight line 101 and the thickness of the second straight line 102 in advance. In the following description, a case where the second straight line 102 is thicker than the first straight line 101 will be described as an example. A dashed line 110 shown in FIG. 2 indicates a detection line detected by the sensor 37. When any one straight line of the plurality of straight lines constituting the correction pattern 100 becomes parallel to the detection line 110, a deviation cannot be detected. Consequently, it is preferable that the correction pattern 100 be constituted by a plurality of straight lines, not parallel to the detection line 110 and having a predetermined angle, which intersect each other. Although the correction pattern for only one color is shown in FIG. 2, the correction pattern 100 corresponding to each color is formed on the transfer belt 31 or a sheet.

Next, referring back to FIG. 1, details of the image forming unit 30 will be described. The image forming unit 30 includes the transfer belt 31, an exposure unit 32, a plurality of developing devices 33 (developing devices 33Y, 33M, 33C, and 33K), a plurality of photoreceptor drums 34 (photoreceptor drums 34Y, 34M, 34C, and 34K), a transfer unit 35, a plurality of primary transfer rollers 36 (36-1 to 36-4) and the sensor 37.

The transfer belt 31 is an endless intermediate transfer body. The transfer belt 31 is rotated in a direction (counterclockwise) indicated by an arrow due to the rotation of a roller. The exposure unit 32 is provided at a position facing the photoreceptor drum 34 between the developing device 33 and a charger (not shown). The exposure unit 32 irradiates the surfaces (photoreceptor layers) of the photoreceptor drums 34Y, 34M, 34C, and 34K with a laser beam based on image information. A direction in which the photoreceptor drums are scanned with the laser beam is a main scanning direction, and a direction perpendicular to the main scanning direction is a sub-scanning direction. For example, in the present embodiment, the main scanning direction is consistent with an axial direction of the photoreceptor drum, and the sub-scanning direction is consistent with a rotation direction of the transfer belt.

Charge on the surfaces (photoreceptor layers) of the photoreceptor drums 34Y, 34M, 34C, and 34K disappears due to irradiation with a laser beam. As a result, a pattern of static electricity is formed at a position irradiated with a laser beam on the surfaces of the photoreceptor drums 34Y, 34M, 34C, and 34K. That is, an electrostatic latent image is formed on the surfaces of the photoreceptor drums 34Y, 34M, 34C, and 34K due to irradiation with a laser beam using the exposure unit 32. Meanwhile, the exposure unit 32 may use light emitting diode (LED) light instead of a laser beam. Light emission of the exposure unit 32 is controlled on the basis of image information under the control of the control apparatus 70.

The developing devices 33Y, 33M, 33C, and 33K supply toners to the photoreceptor drums 34Y, 34M, 34C, and 34K. For example, the developing device 33Y develops the electrostatic latent image on the surface of the photoreceptor drum 34Y using a yellow (Y) toner. In addition, the developing device 33M develops the electrostatic latent image on the surface of the photoreceptor drum 34M using a magenta (M) toner. In addition, the developing device 33C develops the electrostatic latent image on the surface of the photoreceptor drum 34C using a cyan (C) toner. In addition, the developing device 33K develops the electrostatic latent image on the surface of the photoreceptor drum 34K using a black (K) toner.

The developing devices 33Y, 33M, 33C, and 33K form a toner image as a visible image on the photoreceptor drums 34Y, 34M, 34C, and 34K. The toner image formed on the photoreceptor drums 34Y, 34M, 34C, and 34K is transferred (primary transfer) onto the transfer belt 31 by the primary transfer rollers 36-1 to 36-4. The primary transfer roller 36-1 is provided at a position facing the photoreceptor drum 34Y with the transfer belt 31 interposed therebetween. The primary transfer roller 36-2 is provided at a position facing the photoreceptor drum 34M with the transfer belt 31 interposed therebetween. The primary transfer roller 36-3 is provided at a position facing the photoreceptor drum 34C with the transfer belt 31 interposed therebetween. The primary transfer roller 36-4 is provided at a position facing the photoreceptor drum 34K with the transfer belt 31 interposed therebetween.

The transfer unit 35 includes a supporting roller 35*a* and a secondary transfer roller 35*b*. The transfer unit 35 transfers the toner image on the transfer belt 31 to a sheet 41 at a secondary transfer position U. The secondary transfer position U is a position where the supporting roller 35*a* and the secondary transfer roller 35*b* face each other with the transfer belt 31 interposed therebetween. The transfer unit 35 applies a transfer bias to be controlled using a transfer current to the transfer belt 31. The transfer unit 35 transfers the toner image on the transfer belt 31 to the sheet 41 using the transfer bias. The transfer current is controlled by the control apparatus 70.

Figure 3:
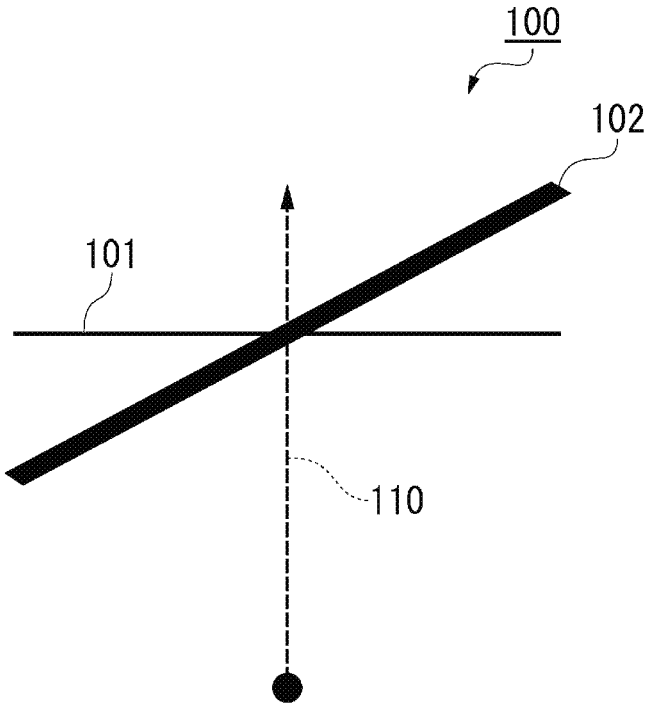
FIG. 3 is a diagram showing an example of a case where a correction pattern is formed at a position where an intersection point of the correction pattern passes through a detection line.
Figure 4:
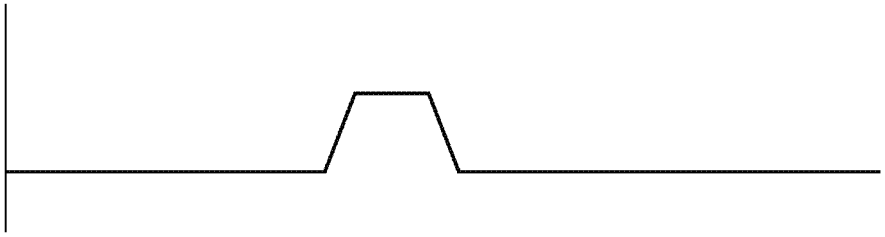
FIG. 4 is a diagram showing results of detection of a correction pattern under conditions shown in FIG. 3.

The sensor 37 detects the correction pattern 100 formed on the transfer belt for each color. The sensor 37 transmits detection results of the correction pattern 100 to the control apparatus 70. Processing of the sensor 37 will be described using FIGS. 3 to 8. FIG. 3 is a diagram showing an example of a case where the correction pattern 100 is formed at a position where an intersection point of the correction pattern 100 passes through the detection line 110. In a case of the example shown in FIG. 3, the sensor 37 detects an intersection point of the correction pattern 100 and outputs detection results as shown in FIG. 4. As shown in FIG. 4, since the sensor 37 detects the intersection point of the correction pattern 100, a result indicating that the intersection point is detected only once is output.

Figure 5:
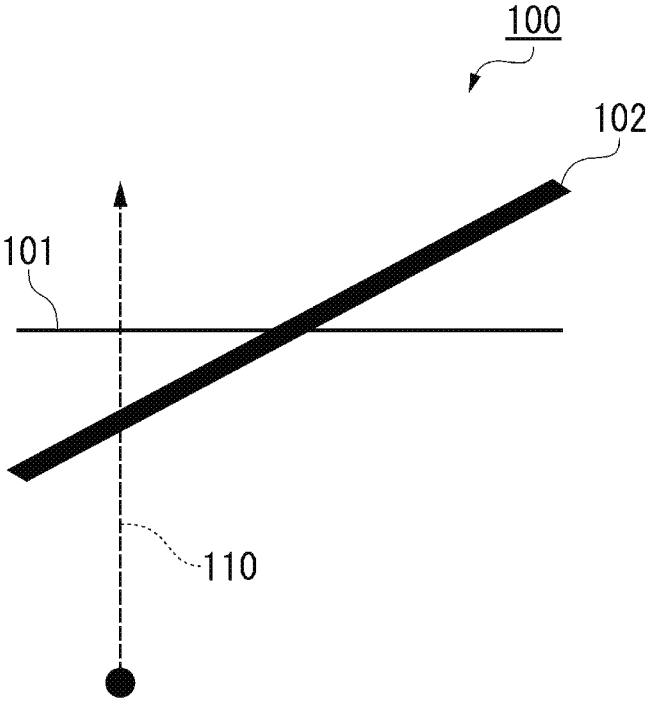
FIG. 5 is a diagram showing an example of a case where a correction pattern is formed at a position where the correction pattern passes to the right of a detection line.
Figure 6:
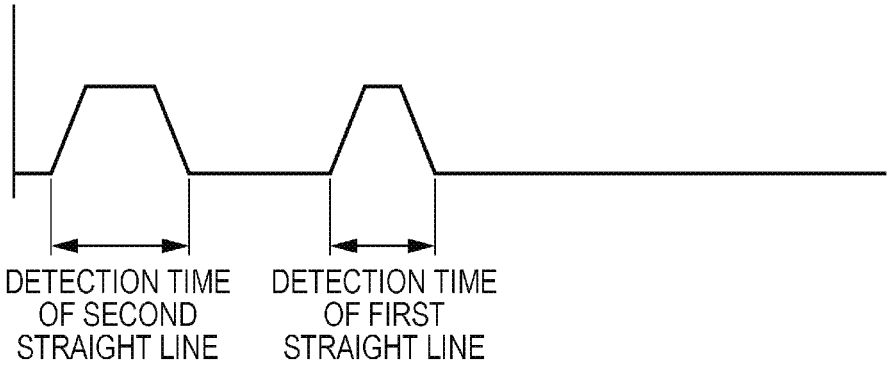
FIG. 6 is a diagram showing results of detection of a correction pattern under conditions shown in FIG. 5.

FIG. 5 is a diagram showing an example of a case where the correction pattern 100 is formed at a position where the correction pattern 100 passes to the right of the detection line 110. In a case of the example shown in FIG. 5, the sensor 37 detects the second straight line 102 and then detects the first straight line 101, and outputs detection results as shown in FIG. 6. As shown in FIG. 6, since the sensor 37 detects the second straight line 102 and then detects the first straight line 101, a result indicating that the straight line is detected twice is output. In the example shown in FIG. 5, the second straight line 102 is thicker than the first straight line 101. For this reason, a detection time of the second straight line 102 is longer than a detection time of the first straight line 101 as a detection result of the sensor 37.

Figure 7:
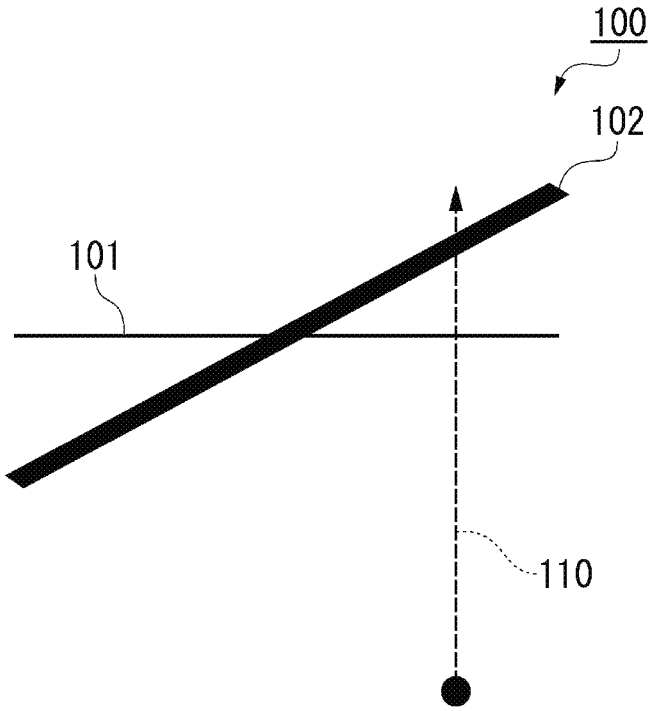
FIG. 7 is a diagram showing an example of a case where a correction pattern is formed at a position where the correction pattern passes to the left of the detection line.
Figure 8:
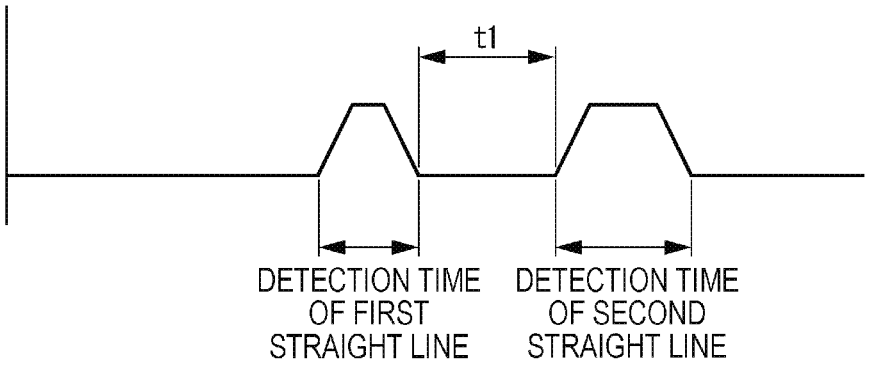
FIG. 8 is a diagram showing results of detection of a correction pattern under conditions shown in FIG. 7.

FIG. 7 is a diagram showing an example of a case where the correction pattern 100 is formed at a position where the correction pattern 100 passes to the left of the detection line 110. In a case of the example shown in FIG. 7, the sensor 37 detects the first straight line 101 and then detects the second straight line 102, and outputs detection results as shown in FIG. 8. As shown in FIG. 8, since the sensor 37 detects the first straight line 101 and then detects the second straight line 102, a result indicating that the straight line is detected twice is output. In the example shown in FIG. 7, the second straight line 102 is thicker than the first straight line 101. For this reason, a detection time of the second straight line 102 is longer than a detection time of the first straight line 101 as a detection result of the sensor 37.

As described above, the correction pattern 100 is constituted by a plurality of straight lines having different thicknesses. For this reason, when results as shown in FIG. 6 and FIG. 8 are obtained, it is possible to determine a direction in which a formation position of the correction pattern 100 deviates. For example, when a detection result of the sensor is obtained once, it can be determined that an intersection point of the correction pattern 100 passes through the detection line 110. When a detection result of the sensor is obtained twice and a first detection time is longer than a second detection time, it can be determined that an intersection point of the correction pattern 100 is positioned on the right side of a main scanning position. When a detection result of the sensor is obtained twice and a first detection time is shorter than a second detection time, it can be determined that an intersection point of the correction pattern 100 is positioned on the left side of the main scanning position. From this, it can be determined to which side deviation in the main scanning direction makes the pattern deviate in the direction of the intersection point. Meanwhile, these determinations are limited to a case where the correction pattern 100 has configurations shown in FIGS. 3, 5, and 8. When another examples are used as the correction pattern 100, the correction pattern 100 may be set in advance in the image forming apparatus 1.

Returning to FIG. 1, the description will be continued. The sheet accommodation portion 40 includes a single paper feed cassette or a plurality of paper feed cassettes. The paper feed cassette accommodates sheets 41 of a predetermined size and a predetermined type. The paper feed cassette includes a pickup roller. The pickup roller takes out the sheets 41 one by one from the paper feed cassette. The pickup roller supplies the taken-out sheets 41 to a transport unit 80.

The fixing device 50 executes an image fixing process. Specifically, the fixing device 50 fixes an image (for example, a toner image) formed on the sheet 41 onto the sheet 41 by performing heating and pressurization on the sheet 41. The fixing device 50 includes a heating source 51, a heating roller 52, and a pressure roller 53. The heating source 51 is a heater lamp including a halogen lamp, an induction heating type heater, or the like. The heating source 51 is turned on or turned off depending on whether a current is applied from the control apparatus 70. The heating roller 52 heated by heat generated by a current applied to the heating source 51. The heating roller 52 applies heat to the sheet 41. The pressure roller 53 is installed to face the heating roller 52. The pressure roller 53 presses the sheet 41 against the heating roller 52.

The transport rollers 61*a* and 61*b* supply the sheet 41 supplied from the paper feed cassette to the image forming unit 30. The transport rollers 61*a* and 61*b* are installed at opposing positions.

The paper discharge rollers 62*a* and 62*b* discharge the sheet 41 on which an image is formed by the fixing device 50, to a discharging unit. The paper discharge rollers 62*a* and 62*b* are installed at opposing positions.

The control apparatus 70 controls the functional units of the image forming apparatus 1.

The transport unit 80 transports the sheet 41. The transport unit 80 includes a transport path and a plurality of rollers not shown in the drawing. The transport path is a path through which the sheet 41 is transported. The rollers rotate under the control of the control apparatus 70 to transport the sheet 41.

Figure 9:
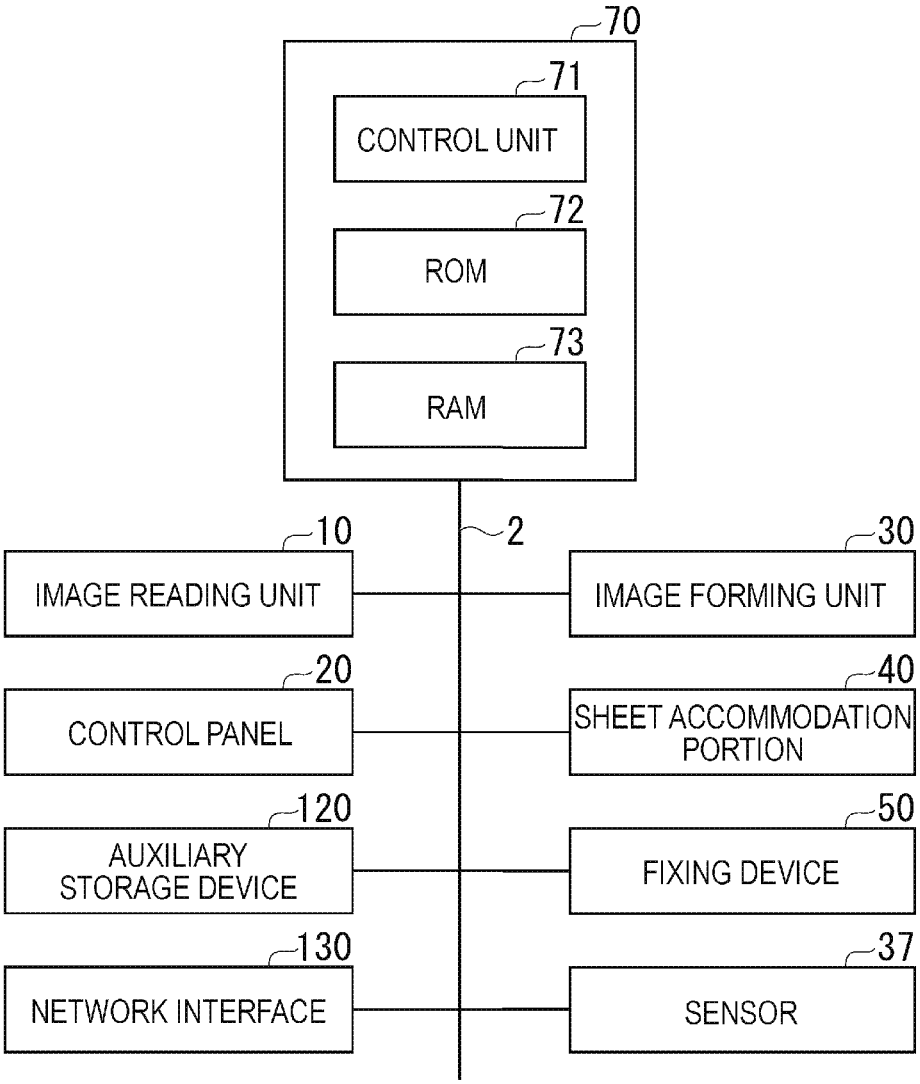
FIG. 9 is a block diagram showing a hardware configuration of the image forming apparatus.

FIG. 9 is a block diagram showing a hardware configuration of the image forming apparatus 1 according to the embodiment. Meanwhile, in FIG. 9, only a characteristic hardware configuration of the image forming apparatus 1 in the present embodiment is shown.

The image forming apparatus 1 includes the image reading unit 10, the control panel 20, the image forming unit 30, the sensor 37, the sheet accommodation portion 40, the fixing device 50, the control apparatus 70, an auxiliary storage device 120, and a network interface 130. The functional units are connected to each other so as to be capable of performing data communication through a system bus 2.

The image reading unit 10, the control panel 20, the image forming unit 30, the sensor 37, the sheet accommodation portion 40 and the fixing device 50 are described above, and thus the description thereof will be omitted. Hereinafter, the control apparatus 70, the auxiliary storage device 120 and the network interface 130 will be described.

The control apparatus 70 includes a control unit 71, a read only memory (ROM) 72, and a random access memory (RAM) 73. The control unit 71 is a processor such as a central processing unit (CPU) or a graphics processing unit (GPU). The control unit 71 controls operations of the functional units of the image forming apparatus 1. The control unit 71 executes various processes by developing a program stored in the ROM 72 to the RAM 73 and executing the program. Meanwhile, an application specific integrated circuit (ASIC) may perform an appropriate function realized by the control unit 71. The ASIC is a dedicated circuit for realizing a specific function.

Next, a specific operation of the control unit 71 will be described.

The control unit 71 adjusts a writing position in the main scanning direction for each color on the basis of the correction pattern 100 detected by the sensor 37. First, the control unit 71 determines a deviation direction in accordance with detection times of the first straight line 101 and the second straight line 102 constituting the correction pattern 100 detected by the sensor 37. Next, the control unit 71 determines a deviation amount for each color in accordance with detection intervals of the first straight line 101 and the second straight line 102. Thereafter, the control unit 71 adjusts a writing position in the main scanning direction for each color so that a deviation of the determined deviation amount is eliminated. In addition, the control unit 71 causes the image forming unit 30 to form the correction pattern 100 again for each color. Meanwhile, a deviation amount may be set in advance. In this case, the control unit 71 may not calculate a deviation amount.

The ROM 72 stores a program for operating the control unit 71. The RAM 73 temporarily stores data used by the functional units included in the image forming apparatus 1. For example, the RAM 73 stores the correction pattern 100 and the deviation amount in the main scanning direction. Meanwhile, the RAM 73 may store digital data generated by the image reading unit 10. The RAM 73 may temporarily store a job and a job log.

The auxiliary storage device 120 is, for example, a hard disk or a solid state drive (SSD) and stores various data. The various data includes, for example, the digital data, the job, the job log, the correction pattern 100, the deviation amount in the main scanning direction, and the like.

The network interface 130 transmits and receives data to and from another apparatus. Here, another apparatus is an information processing apparatus such as a personal computer. The network interface 130 operates as an input interface and receives data or an instruction transmitted from another apparatus. The instruction transmitted from another apparatus is an instruction for executing printing, or the like. In addition, the network interface 130 operates as an output interface and transmits data to another apparatus.

Figure 10:
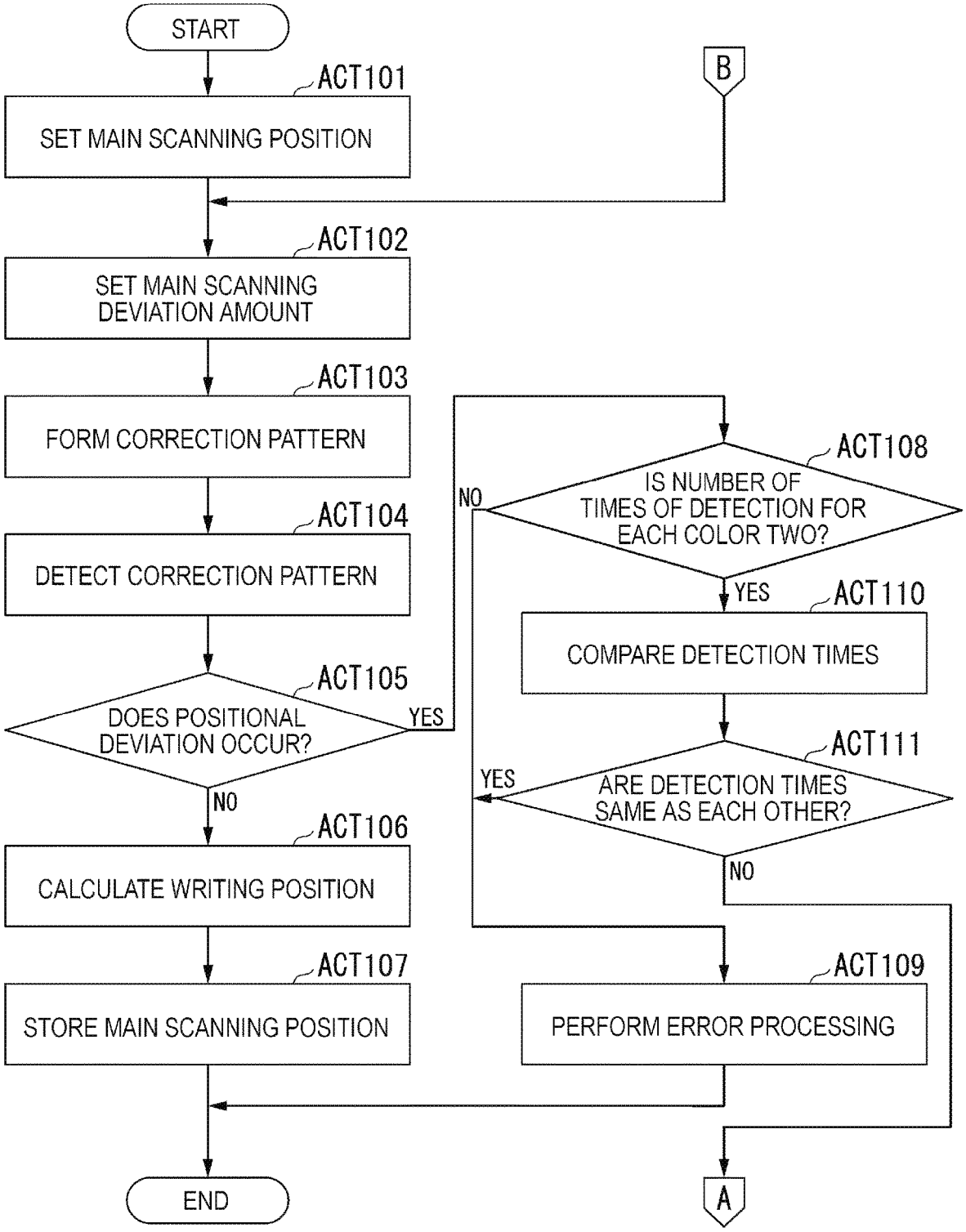
FIG. 10 is a flowchart showing a flow of processing performed by the image forming apparatus.
Figure 11:
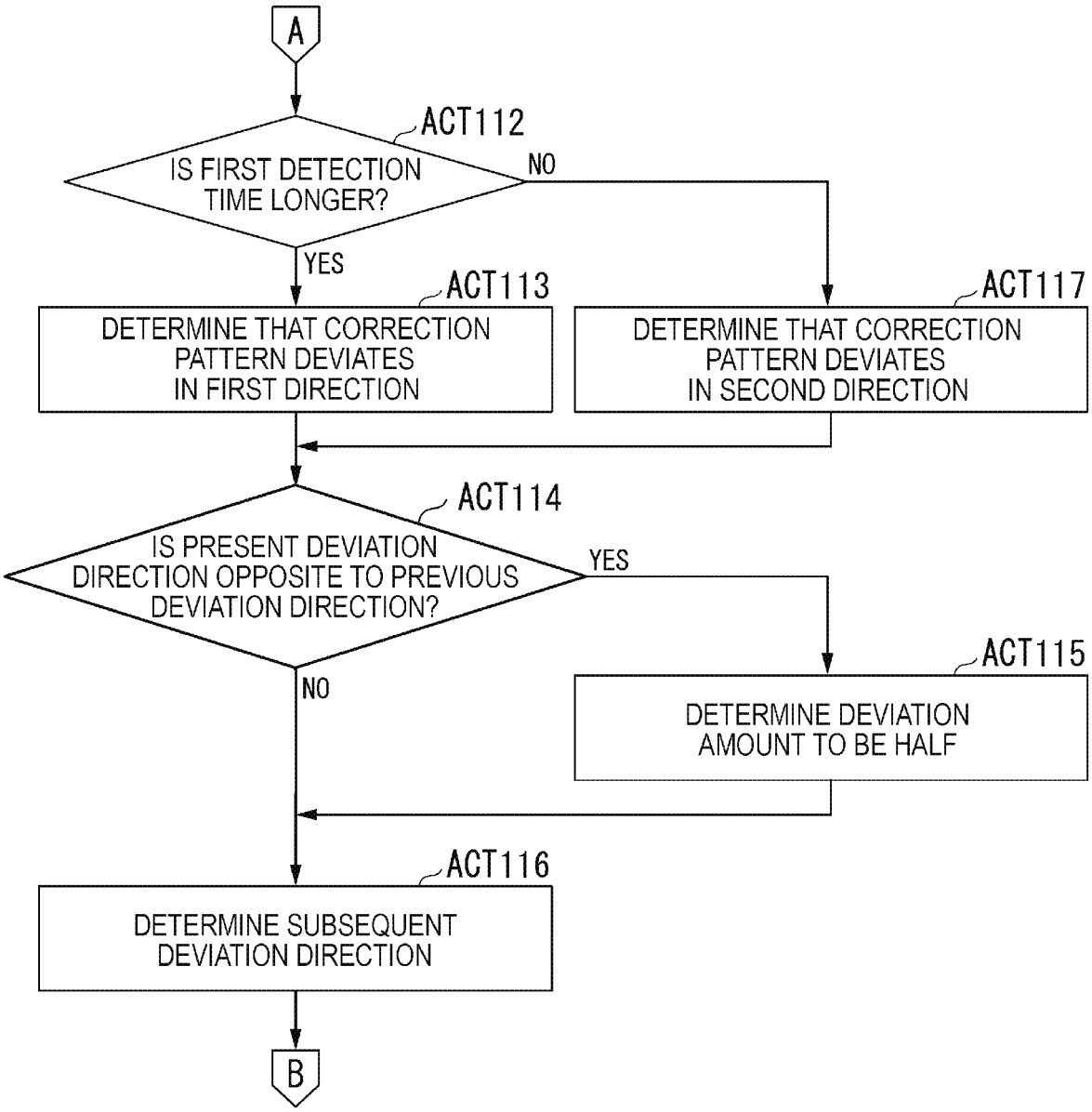
FIG. 11 is a flowchart showing a flow of processing performed by the image forming apparatus.

FIGS. 10 and 11 are flowcharts showing a flow of processing performed by the image forming apparatus 1 in the embodiment. The processing shown in FIGS. 10 and 11 is executed when an instruction for image position adjustment is given.

The control unit 71 sets a main scanning position (ACT101). For example, the control unit 71 sets an initial main scanning position or a previous main scanning position in the image forming unit 30. In addition, the control unit 71 sets a main scanning deviation amount which is a deviation amount for adjusting the main scanning position (ACT102). When the processing is started, the control unit 71 sets an initial value of the deviation amount. It is assumed that the initial value of the deviation amount is stored in the RAM 73 or the auxiliary storage device 120.

The image forming unit 30 forms the correction pattern 100 on the transfer belt 31 for each color (ACT103). Specifically, the image forming unit 30 forms the correction pattern 100 which is not parallel to the detection line 110 of the sensor 37 and has a predetermined angle on the transfer belt 31. The sensor 37 reads the correction pattern 100 formed on the transfer belt 31 to output detection results of the correction pattern 100 to the control apparatus 70 (ACT104). The sensor 37 outputs detection results for each color to the control apparatus 70. The control unit 71 acquires the detection results for each color which are output from the sensor 37. The control unit 71 determines for each color whether or not a deviation occurs at a writing position in the main scanning direction with reference to the acquired detection results for each color (ACT105).

When a deviation occurs at the writing position in the main scanning direction, the number of times of detection of the sensor 37 is two in one color as shown in FIGS. 6 and 8. When there is at least one color in which the number of times of detection is two or more, the control unit 71 determines that a deviation occurs at the writing position in the main scanning direction. When there is no color in which the number of times of detection is two or more, that is, when the number of times of detection is one, the control unit 71 determines that a deviation does not occur at the writing position in the main scanning direction. A case where the number of times of detection is one means that the sensor 37 detects an intersection point of the correction pattern 100 as shown in FIG. 4.

When a deviation does not occur at the writing position in the main scanning direction (ACT105: NO), the control unit 71 calculates a writing position in the main scanning direction (ACT106). Specifically, the control unit 71 calculates the writing position in the main scanning direction on the basis of the writing position of the correction pattern 100. Thereafter, the control unit 71 stores the calculated writing position in the main scanning direction in the RAM 73 or the auxiliary storage device 120 as a main scanning position (ACT107). When a positional deviation for each color does not occur from the start of the processing, the main scanning position which is set as an initial value is stored as it is. When a deviation occurs at the writing position in the main scanning direction (ACT105: YES), the control unit 71 determines whether or not the number of times of detection for each color is two (ACT108). The control unit 71 determines that the number of times of detection for each color is two when there is no color in which the number of times of detection is zero, the number of times of detection is two in at least one color, and there is no color in which the number of times of detection is more than two. An example is as follows. When the number of times of detection is two of the correction pattern 100 of a certain color and the number of times of detection of the correction patterns 100 of the other colors is one, the control unit 71 determines that the number of times of detection for each color is two. In addition, when the number of times of detection of the correction patterns 100 of all colors is two, the control unit 71 determines that the number of times of detection for each color is two. On the other hand, when the number of times of detection is three or more in one color or when the number of times of detection is zero in one color, the control unit 71 determines that the number of times of detection for each color is not two.

When the number of times of detection for each color is not two (ACT108: NO), the number of times of detection in at least one color is zero, or three or more. In this case, the number of times of detection is less or more than the number of times of detection originally performed in the correction pattern 100. For this reason, the control unit 71 performs error processing on the assumption that there is any abnormality (ACT109). As the error processing, the control unit 71 may display an error screen on the control panel 20 or may output a sound. Thereafter, the image forming apparatus 1 terminates the processing.

On the other hand, when the number of times of detection for each color is two (ACT108: YES), the control unit 71 compares detection times of the correction pattern 100 detected in one color with each other (ACT110). More specifically, the control unit 71 compares detection times of the first straight line 101 and the second straight line 102 constituting the correction pattern 100 with each other for each color. Meanwhile, this processing is performed on a color in which the number of times of detection is two. That is, the processing is not executed on a color in which the number of times of detection is one. When the detection time of the first straight line 101 and the detection time of the second straight line 102 are the same as each other (ACT111: YES), the control unit 71 performs error processing (ACT109). In the correction pattern 100 in the present embodiment, a plurality of straight lines has different thicknesses. Therefore, times detected by the sensor 37 should be different. However, there is a strong possibility that any abnormality may occur when the detection time of the first straight line 101 and the detection time of the second straight line 102 are the same as each other. Consequently, the control unit 71 performs error processing when the detection time of the first straight line 101 and the detection time of the second straight line 102 are the same as each other.

On the other hand, when the detection time of the first straight line 101 and the detection time of the second straight line 102 are not the same (ACT111: NO), the control unit 71 executes the process of ACT112. The control unit 71 determines whether or not the first detection time is longer than the second detection time (ACT112). When the first detection time is longer than the second detection time (ACT112: YES), the control unit 71 determines that the correction pattern 100 deviates in a first direction (ACT113). The first direction is, for example, the right. When the first direction is the right, this pattern is the pattern shown in FIG. 5.

Thereafter, the control unit 71 determines whether or not the present deviation direction is opposite to the previous deviation direction (ACT114). For example, when it is determined that the present deviation direction is the right, the control unit 71 determines whether or not the previous deviation direction is the left. In contrast, when it is determined that the present deviation direction is the left, the control unit 71 determines whether or not the previous deviation direction is the right. When the present deviation direction is not opposite to the previous deviation direction (ACT114: NO), the control unit 71 does not adjust a deviation amount. Therefore, the control unit 71 performs the process of ACT116 by maintaining the deviation amount as it is.

The control unit 71 determines the subsequent deviation direction of the correction pattern 100 (ACT116). Specifically, when the previous deviation direction and the present deviation direction are different from each other, the control unit 71 determines the subsequent formation position of the correction pattern 100 to be a direction different from the present deviation direction. For example, when the previous deviation direction is the left and the present deviation direction is the right, the control unit 71 determines the subsequent formation position of the correction pattern 100 to be a direction closer to the left than the present formation position. In addition, when the previous deviation direction and the present deviation direction are the same as each other, the control unit 71 determines the subsequent formation position of the correction pattern to be the same direction as the present formation position.

The subsequent deviation direction and deviation amount of the correction pattern 100 are determined through the above-described processing. After the process of ACT116 is performed, the control unit 71 sets the determined deviation direction and deviation amount of the correction pattern 100 for the image forming unit 30. Meanwhile, the control unit 71 performs the setting of the deviation direction and the deviation amount of the correction pattern 100 on only a color in which the number of times of detection is two.

When the first detection time is shorter than the second detection time (ACT112: NO), the control unit 71 determines that the correction pattern 100 deviates in a second direction (ACT113). The second direction is, for example, the left. When the second direction is the left, this pattern is the pattern shown in FIG. 7. Thereafter, the control unit 71 executes the process of ACT114.

When the present deviation direction is opposite to the previous deviation direction in the process of ACT114 (ACT114: YES), the control unit 71 determines a deviation amount to be a half (ACT115). More specifically, when the present deviation direction and the previous deviation direction are the same as each other, the control unit 71 determines a deviation amount in the main scanning direction to be a half. Meanwhile, the deviation amount is not necessarily a half. For example, when the present deviation direction and the previous deviation direction are the same as each other, the control unit 71 may determine a deviation amount in the main scanning direction to be a value smaller than a set deviation amount.

Figure 12:
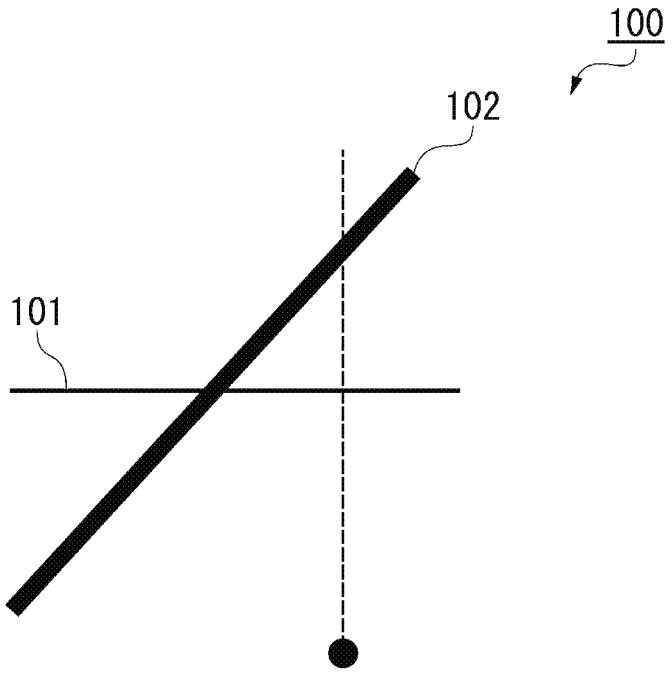
FIG. 12 is a diagram showing an example of a case where a correction pattern is formed on a transfer belt when a sub-scanning magnification deviates to an enlargement side.
Figure 13:
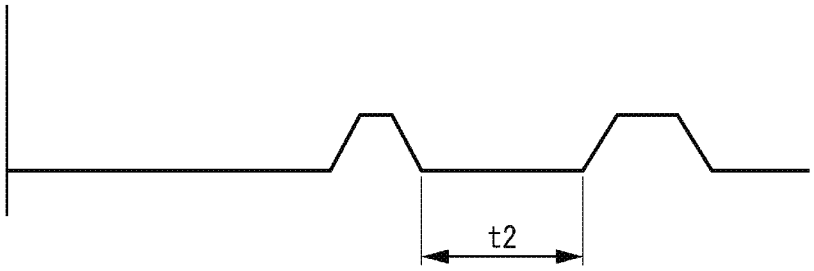
FIG. 13 is a diagram showing detection results when the correction pattern shown in FIG. 12 is detected by a sensor.
Figure 14:
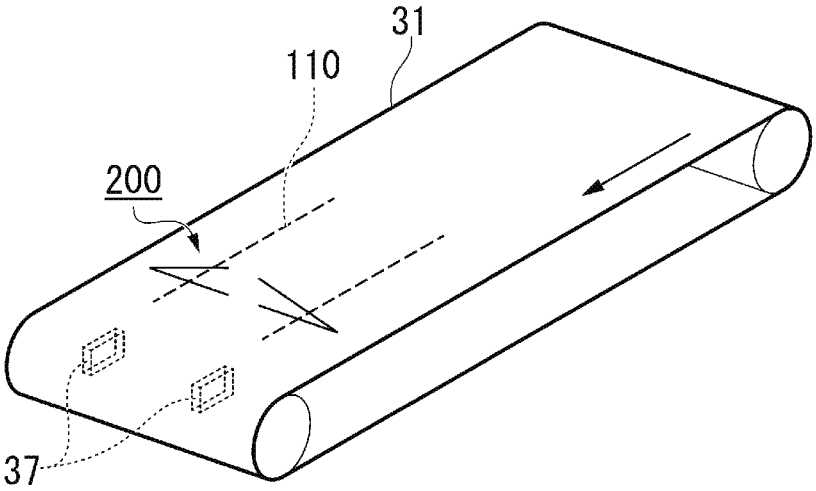
FIG. 14 is a diagram showing a method of adjusting a hitting position in a main scanning direction in the related art.

FIG. 12 is a diagram showing an example of a case where the correction pattern 100 is formed on the transfer belt when a sub-scanning magnification deviates to an enlargement side. In the example shown in FIG. 12, the correction pattern 100 is formed on the transfer belt with the same deviation as in FIG. 7. FIG. 13 is a diagram showing detection results when the correction pattern 100 shown in FIG. 12 is detected by the sensor 37. As shown in FIG. 13, a detection interval t2 between a first detection time and a second detection time is longer than a detection interval t1 in FIG. 8. Even in a state shown in FIG. 12, the number of times of detection of the sensor 37 is only one when the sensor 37 passes through an intersection point between straight lines. Although there is a difference in a detection interval as shown in FIGS. 8 and 13 due to a fluctuation in a sub-scanning magnification, the position of an intersection point of the correction pattern is not influenced by the sub-scanning magnification, and thus it is possible to correctly perform deviation adjustment of main scanning.

According to the image forming apparatus 1 configured as described above, it is possible to perform deviation adjustment of main scanning without being influenced by a sub-scanning magnification by using an intersection point of a correction pattern in which two straight lines intersect each other.

Further, in the image forming apparatus 1 of the present embodiment, the correction pattern 100 is constituted by a plurality of straight lines having different thicknesses and intersecting each other. Thereby, even when an intersection point of the correction pattern 100 is at a position deviating from the detection line 110, it can be understood in which direction the intersection point deviates. Specifically, the plurality of straight lines has different thicknesses, and thus detection times thereof are different from each other. Consequently, the image forming apparatus 1 can determine in which direction the intersection point deviates by comparing lengths of detection times with each other. Therefore, the image forming apparatus 1 adjusts a deviation on the basis of determination results. In this manner, it is possible to adjust a writing position in the main scanning direction by using the correction pattern 100 constituted by a plurality of straight lines having different thicknesses and intersecting each other. For this reason, it is possible to adjust a writing position in the main scanning direction by a simple method.

According to at least one embodiment described above, an image forming apparatus includes an image forming unit, a sensor, and a control unit. The image forming unit forms a pattern constituted by a plurality of straight lines intersecting each other for each color on a sheet or a transfer belt. The sensor detects the pattern formed on the sheet or the transfer belt for each color. The control unit adjusts a writing position in a main scanning direction for each color on the basis of the pattern detected by the sensor. Thereby, it is possible to adjust the writing position in the main scanning direction by a simple method.

Some functions of the image forming apparatus 1 in the above-described embodiment may be realized by a computer. In this case, a program for realizing the functions is recorded in a computer-readable recording medium. In addition, the functions may be realized by causing a computer system to read and execute the program recorded in the recording medium having the above-described program recorded thereon.

Meanwhile, it is assumed that the "computer system" mentioned herein includes hardware such as an operating system or peripheral devices. In addition, the "computer-readable recording medium" refers to a portable medium, a storage device, or the like. The portable medium is a flexible disk, a magneto-optical disk, a ROM, a CD-ROM, or the like. In addition, the storage device is a hard disk embedded into the computer system, or the like. Further, the "computer-readable recording medium" refers to a medium that dynamically stores a program for a short period of time such as a communication line when a program is transmitted through a communication channel. The communication channel is a network such as the Internet, a telephone line, or the like. In addition, the "computer-readable recording medium" may be a volatile memory inside a computer system serving as a server or a client. The volatile memory is a memory that stores a program for a fixed period of time. In addition, the program may be a program for realizing some of the above-described functions. Further, the program may be a program for realizing some of the above-described functions in combination with a program recorded in the computer system in advance.

While certain embodiments have been described, these embodiments have been presented by way of example only, and are not intended to limit the scope of the present disclosure. Indeed, the novel embodiments described herein may be embodied in a variety of other forms: furthermore various omissions, substitutions and changes in the form of the embodiments described herein may be made without departing from the spirit of the present disclosure. The accompanying claims and there equivalents are intended to cover such forms or modifications as would fall within the scope and spirit of the present disclosure.

What is claimed is:

1. An image forming apparatus comprising:

an image forming unit including an image carrier and configured to form a pattern on the image carrier, the pattern comprising a plurality of straight lines intersecting each other;

a sensor configured to detect the pattern formed on the image carrier; and a control unit configured to determine a writing position adjustment based upon the pattern detected by the sensor and to adjust a writing position in a main scanning direction based on the writing position adjustment;

wherein the sensor is further configured to detect an intersection point between the plurality of straight lines in response to detecting that a formation position of the pattern does not deviate; and wherein the control unit is configured to determine that the formation position does not deviate when the intersection point is detected as a detection result of the pattern.

2. The image forming apparatus of claim 1, wherein each of the plurality of straight lines has a different thickness.

3. The image forming apparatus of claim 1, wherein:

the sensor is defined by a detection line; and the image forming unit is configured to cause the pattern to be formed such that none of the plurality of straight lines is parallel to the detection line.

4. An image forming apparatus comprising:

an image forming unit including an image carrier and configured to form a pattern on the image carrier, the pattern comprising a plurality of straight lines intersecting each other;

a sensor configured to detect the pattern formed on the image carrier; and a control unit configured to determine a writing position adjustment based upon the pattern detected by the sensor and to adjust a writing position in a main scanning direction based on the writing position adjustment;

wherein the image forming unit is configured such that the pattern includes two straight lines having different thicknesses and intersecting each other on the image carrier.

5. The image forming apparatus of claim 4, wherein:

the sensor is further configured to detect the pattern in response to detecting a deviation at a formation position of the pattern; and the control unit is further configured to determine a deviation direction in which the formation position of the pattern deviates in accordance with detection times of the pattern.

6. The image forming apparatus of claim 5, wherein the control unit is further configured to determine a deviation amount in accordance with a detection interval of the pattern, adjusts the deviation amount, and cause the image forming unit to form the pattern.

7. The image forming apparatus of claim 5, wherein the control unit is further configured to determine a deviation amount, compare the deviation direction to a previous deviation direction, determine a threshold based upon the comparison between the deviation direction and the previous deviation direction, compare the deviation amount to the threshold, and cause the pattern to deviate by the deviation amount in response to determining that the deviation amount is smaller than the threshold.

8. The image forming apparatus of claim 4, wherein each of the plurality of straight lines has a different thickness.

9. The image forming apparatus of claim 4, wherein:

the sensor is defined by a detection line; and the image forming unit is configured to cause the pattern to be formed such that none of the plurality of straight lines is parallel to the detection line.

10. An image forming apparatus comprising:

an image forming unit including an image carrier and configured to form a pattern on the image carrier, the pattern comprising a plurality of straight lines intersecting each other;

a sensor configured to detect the pattern formed on the image carrier; and a control unit configured to determine a writing position adjustment based upon the pattern detected by the sensor and to adjust a writing position in a main scanning direction based on the writing position adjustment;

wherein the control unit is further configured to increment a number of times of detection in response to detecting the pattern, compare the number of times of detection to a threshold, perform error processing in response to determining that the number of times of detection is equal to or greater than the threshold, and perform error processing in response to not detecting the pattern.

11. An image position adjustment method comprising:

forming a pattern on an image carrier, the pattern comprising a plurality of straight lines intersecting each other;

detecting the pattern;

adjusting a writing position of an image forming unit in a main scanning direction on the basis of the pattern;

determining a formation position of the pattern in response to detecting the pattern;

storing the formation position;

determining a deviation by comparing the formation position to a previous formation position;

determining a deviation direction based on the deviation;

comparing the deviation direction to a previous deviation direction;

determining a threshold based upon the comparison between the deviation direction and the previous deviation direction;

comparing the deviation to the threshold; and causing the pattern to deviate by the deviation amount in response to determining that the deviation is smaller than the threshold.

12. The method of claim 11, further comprising selecting a thickness of each of the plurality of straight lines such that each of the plurality of straight lines has a different thickness.

13. The method of claim 11, further comprising determining a location of a detection line;

wherein the pattern is formed on the image carrier such that none of the plurality of straight lines is parallel to the detection line.

14. An image position adjustment method comprising:

forming a pattern on an image carrier, the pattern comprising a plurality of straight lines intersecting each other;

detecting the pattern;

adjusting a writing position of an image forming unit in a main scanning direction on the basis of the pattern;

determining a formation position of the pattern in response to detecting the pattern;

storing the formation position;

determining a deviation by comparing the formation position to a previous formation position;

determining a deviation direction based on the deviation;

incrementing a number of times of detection in response to detecting the pattern;

comparing the number of times of detection to a threshold; and performing error processing in response to determining that the number of times of detection is equal to or greater than the threshold.

15. The method of claim 14, further comprising performing error processing in response to not detecting the pattern.

* * * * *